US005449082A

United States Patent [19]

Reynard

[11] Patent Number: 5,449,082

[45] Date of Patent: Sep. 12, 1995

[54] LIFT FITTING FOR CARGO CONTAINERS

[76] Inventor: Kenneth Reynard, Unit 1, South Church Enterprise Park, Bishop Auckland, Co Durham DL14 6XB, Great Britain

[21] Appl. No.: 199,244

[22] PCT Filed: Jun. 24, 1993

[86] PCT No.: PCT/GB93/01333

§ 371 Date: Oct. 31, 1994

§ 102(e) Date: Oct. 31, 1994

[87] PCT Pub. No.: WO94/00369

PCT Pub. Date: Jan. 6, 1994

[30] Foreign Application Priority Data

Jun. 24, 1992 [GB] United Kingdom ..... 9213561

[51] Int. Cl.[6] ..... B65D 90/00

[52] U.S. Cl. ..... 220/1.5

[58] Field of Search ..... 220/1.5, 581, 586, 592, 220/4.01

[56] References Cited

U.S. PATENT DOCUMENTS

| | | | |
|---|---|---|---|
| 3,591,033 | 7/1971 | Partridge | 220/1.5 |
| 3,868,042 | 2/1975 | Bodeniteimer | 220/1.5 |
| 5,191,743 | 3/1993 | Romig et al. | 220/1.5 |
| 5,222,621 | 6/1993 | Matias | 220/1.5 |
| 5,255,806 | 10/1993 | Korzeniowski et al. | 220/1.5 |

FOREIGN PATENT DOCUMENTS

| | | |
|---|---|---|
| 0401391 | 12/1990 | European Pat. Off. . |
| WO92/13782 | 8/1992 | WIPO . |

*Primary Examiner*—Joseph Man-Fu Moy
*Attorney, Agent, or Firm*—Workman, Nydegger & Seeley

[57] ABSTRACT

A cargo container of non-standard length comprises a base, a roof, an opposed pair of side walls extending between the base and the roof and joined thereto along the lower and upper edges of the side walls respectively, an opposed pair of end walls adjoining the side walls along four corner edges of the container, opposed pairs of lift fittings mounted along the upper edges of the side walls at spacings in board of the corner edges and spaced apart from each other along the upper edges by predetermined distances to correspond to requirements of standard container lifter device and a respective portal frame arranged to strengthen the roof and the side walls at a position corresponding to the location of each pair of opposed lift fittings in which each lift fitting comprises a hollow body arranged to receive a respective container lifter device, an upper recess in the hollow body to allow the container lifter device to enter the body, a lower recess arranged to receive an inner post stiffener and to rigidly secure the fitting thereto with the inner stiffener being secured to an outer post forming an upright member of the respective portal frame.

20 Claims, 4 Drawing Sheets

LIFT FITTING FOR CARGO CONTAINERS

This invention relates to lift fittings for cargo containers, and is particularly, though not exclusively, concerned with lift fittings positioned inboard from the ends of cargo containers of non-standard lengths i.e. cargo containers which do not conform to present international standard lengths.

Cargo containers have become the standard means of transportation of material by road, rail and sea. As a result of their universal usage, standards have been established with respect to the size of cargo containers and design of cargo containers, so that they can be transported anywhere in the world using uniform lifting points. These uniform lifting points are required, in that cargo containers are most often lifted and moved by vehicular cranes or marine cranes, which either load or unload cargo containers onto flat bed trucks or railroad cars, or load or unload ocean-going container vessels. Container lifter devices currently in use include so-called ISO twistloks, and so-called "crane spreaders" with locking devices, which are generally T-shaped and which are presented in one angular setting to be received by conventional lift fittings, and are then rotated through 90° to a locking position prior to lifting operations taking place.

The established standardised lengths of cargo containers are 10 feet, 20 feet, 30 feet and 40 feet. Containers of these dimensions usually have their lifting points formed by lift fittings located at or near the corners of the containers on the roof thereof, so that each lift fitting has the benefit of two intersecting walls for support, namely adjoining side and end walls. Each wall normally has horizontal support members which are secured to the lift fitting, and a vertical post is also provided at the intersection between the two walls which is also secured to the lift fitting. In this way, the rectangular box-like integrity of the container is maintained i.e. there is no projection into the container void from the walls of the container, and the structural strength of the container is maintained by the interconnection of the lift fittings and the horizontal and vertical supports.

However, recent developments in the United States, Canada and Mexico have led to the development of domestic containers of non-standard lengths, in order to accommodate high volume pay loads and reduce the associated cost of shipping. These non-standard containers utilised in the UK domestic market are typically found in lengths of 45 feet, 48 feet and 53 feet. Despite the non-standard length of these containers, they must still be capable of being lifted with vehicular cranes or marine cranes which are designed to the international standard i.e. designed to engage lift fittings at standard spacings apart on the corners of standard size containers. Therefore, the lifting points which are provided on non-standard length containers must be located inboard from the corner ends of the containers. It is known to fit these lifting points in non-standard length containers in portal frames built into the structure of the containers, but due to the fact that the lift fittings and the portal frames do not provide as much support strength and rigidity as is available by adjoining side and end walls (with lift fittings on standard length containers), the necessity arises to provide additional supporting strength to the portal frames to withstand transverse loads imposed during transportation.

The current techniques adopted to solve the problems of lack of rigidity of portal frames in non-standard length containers is to provide large triangular gussets which stiffen the portal frames. These gussets are located internally of the non-standard length container, and therefore project into the cargo space, and accordingly reduce the effective volume which can be utilised. Thus, while the triangular gussets only project into the container volume at the portal frames, cargo is usually loaded only through one end, and if cargo is to be moved through at least part of the length of the container, the maximum size of the cargo will be limited by the space made available by each gusset-supported portal frame which the cargo has to move through. The gusset plates therefore make internal loading of the container difficult, and reduce the effective utilisation of the cargo space defined within the container.

The present invention has therefore been developed primarily, though not exclusively, with a view to providing an improved mounting of lift fittings on cargo containers of non-standard length, which provide sufficient rigidity so that no additional internal stiffening is required, (which stiffening might project into the cargo space and otherwise reduce the effective volume of usable cargo space), and such mountings still maintaining required structural integrity of the container when being lifted, lowered and transported.

According to one aspect of the invention there is provided a cargo container comprising a base, a roof, an opposed pair of side walls extending between the base and the roof and joined thereto along the lower and upper edges of the side walls respectively, an opposed pair of end walls adjoining the side walls along four corner edges of the container, opposed pairs of lift fittings mounted along the upper edges of the side walls at spacings inboard of the corner edges and spaced apart from each other along the upper edges by predetermined distances to correspond with the requirements of container lifter devices, and a respective portal frame arranged to strengthen the roof and the side walls at a position corresponding to the location of each pair of opposed lift fittings, in which each lift fitting comprises:

a hollow body arranged to receive a respective container lifter device;

an upper recess in the hollow body to allow the container lifter device to enter the body; and, a lower recess arranged to receive an inner post stiffener and to rigidly secure the fitting thereto, said inner stiffener being secured to an outer post forming an upright member of the respective portal frame.

Preferably, in the cargo container according to said one aspect of the invention, the hollow body of the lift fitting has an apertured flexible lower wall which is arranged to allow downward movement of the container lifter device, after entry into the body, to a captive position below the fitting to permit upward movement of the container via the lifter device and the lift fitting.

According to a second aspect of the invention there is provided a cargo container comprising a base, a roof, an opposed pair of side walls extending between the base and the roof and joined thereto along the lower and upper edges of the side walls respectively, an opposed pair of end walls adjoining the side walls along four corner edges of the container, opposed pairs of lift fittings mounted along the upper edges of the side walls at spacings inboard of the corner edges and spaced apart from each other along the upper edges by predetermined distances to correspond with the requirements of container lifter devices, and a respective portal frame arranged to strengthen the roof and the side walls at a position corresponding to the location of each pair of opposed lift fittings, in which each lift fitting comprises:

a hollow body arranged to receive a respective container lifter device;

an upper recess in the hollow body to allow the container lifter device to enter the body; and, an apertured flexible lower wall arranged to allow downward movement of the container lifter device, after entry into the body, to a captive position below the fitting to permit upward movement of the container via the lifter device and the lift fitting.

In a cargo container according to the second aspect of the invention, preferably a lower recess is arranged to receive an inner post stiffener, and to rigidly secure the fitting thereto, said inner stiffener being secured to an outer post forming an upright member of the respective portal frame.

The lower recess in the hollow body of the or each lift fitting may be formed by a slot extending throughout at least the major part of the height of the fitting.

The upper end of the inner stiffener is received by the slot-like recess, and is housed within the outer post and projects upwardly therefrom to be received by the body.

The outer post is preferably welded at its upper end to the underside of the body of the lift fitting, and the upper end of the inner stiffener may be received throughout the height of the body, and is welded thereto.

The lower side of the hollow body may include an apertured flexible diaphragm which is deformable to allow downward movement of the lifter device upon engagement with the lift fitting and to move to the captive position of engagement therewith.

In a particularly preferred embodiment of the invention, the or each lift fitting is constructed and arranged in such a way that its depth is substantially less than the depth of a standard ISO lift fitting, and which therefore allows the lifter device to move downwardly through the lift fitting to the position of captive engagement therewith. This design of lift fitting minimises internal projection of any parts into the usable cargo space.

Accordingly, in a preferred embodiment of the invention, one or more of the following desired objectives may be achieved:

1. To provide a novel lift fitting for cargo containers which permits non-standard length containers to be lifted using existing cargo cranes;

2. To provide a novel lift fitting for cargo containers which maintains the structural integrity of the shell of the cargo container during lifting;

3. To provide a novel lift fitting for cargo containers which does not require any internal support members within the cargo space of the container, while still maintaining the integrity of the container;

4. To provide a novel lift fitting for cargo containers which allows for increased storage space within the cargo container owing to the absence of internal stiffeners.

A preferred embodiment of cargo container with novel lift fitting mountings will now be described in detail, by way of example only, with reference to the accompanying drawings, in which.

Figure 1:
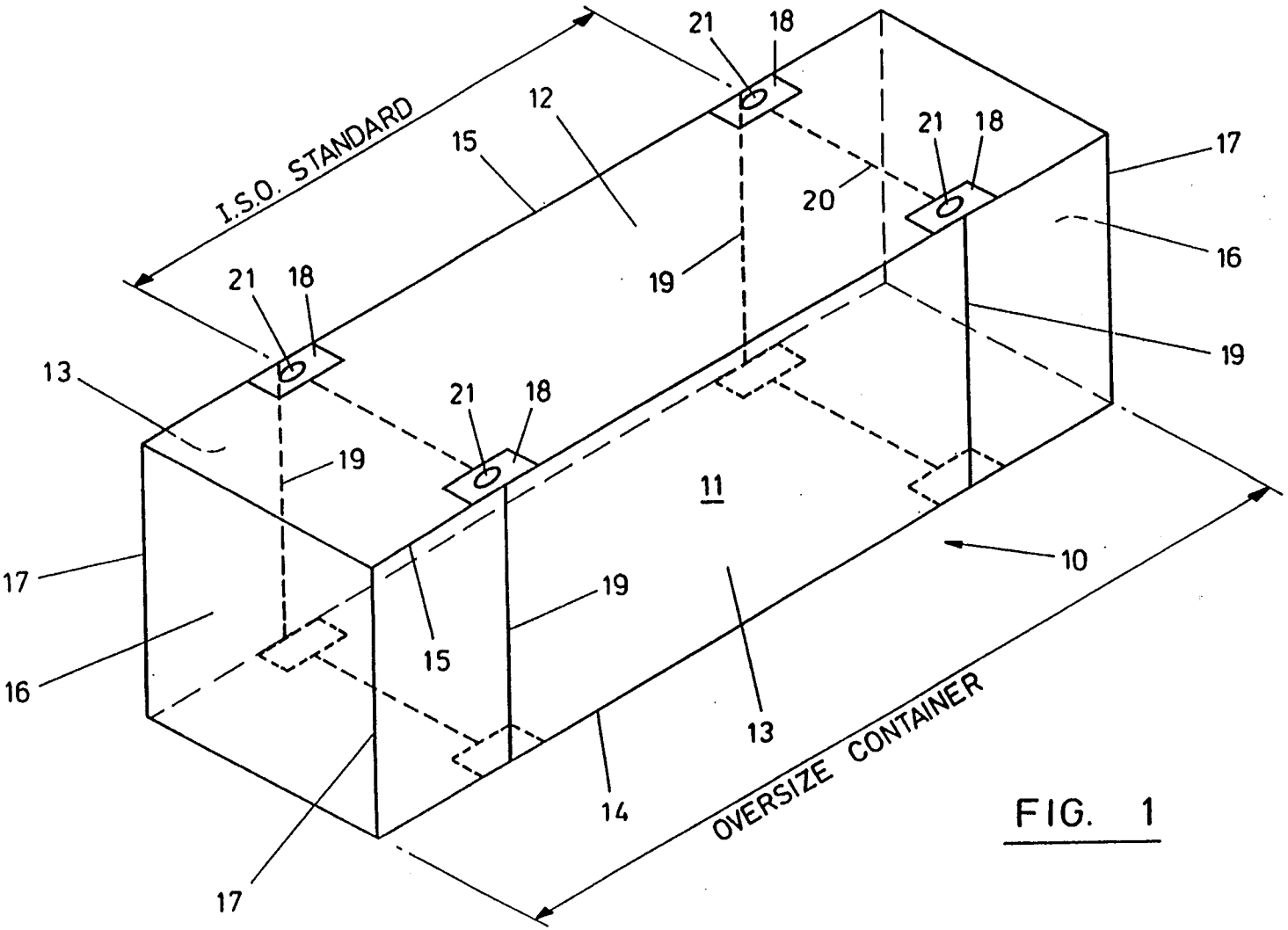
FIG. 1 is a perspective illustration of a non-standard length container having lift fittings mounted thereon in accordance with the invention.

Referring now to the drawings, a preferred embodiment of the invention will now be described with reference to a cargo container 10 of non-standard length. The container 10 comprises a base 11, a roof 12, an opposed pair of side walls 13 extending between the base 11 and the roof 12 and adjoined thereto along lower horizontal edges 14 and upper horizontal edges 15 of the side walls 13 respectively. An opposed pair of end walls 16 adjoin the side walls 13 along four corner edges 17 of the container, and opposed pairs of lift fittings 18 are mounted along the upper edges 15 of the side walls 13 at spacings inboard of the corner edges 17, and are spaced apart from each other along the upper edges 15 by predetermined distances to correspond with requirements of container lifter devices. As shown in FIG. 1, the lift fittings 18 on each side wall upper edge 15 are spaced apart by ISO standard length to accept standard crane operated lifter devices.

As can be seen from FIG. 1, each lift fitting 18 on one side wall faces a corresponding lift fitting on the opposite wall, thereby to form a pair of opposed lift fittings located in a common vertical plane parallel to the end walls 16 of the container.

To strengthen the roof 12 and side walls 13 at each position corresponding to the location of each pair of opposed lift fittings, a respective portal frame is built into the structure of the container, and portal frame is shown schematically in FIG. 1 comprising a pair of upright support members 19 and horizontal top support member 20.

FIG. 1 shows in schematic form only the structural assembly of the container 10 of non-standard length, and the strengthened mounting in position of opposed pairs of lift fittings, and the mounting and assembly of a typical one of the lift fittings is shown in more detail in FIGS. 2 to 4 and which will now be described.

The lift fitting 18 is substantially reduced in height compared with a standard design of lift fitting designed to accept an ISO lifting device, and comprises a hollow metal cast body having a generally rectangular upper recess 21, the axis of which extends generally parallel to the longitudinal axis of the container and to the side wall edges, and which can receive an ISO twistlok type cargo lifter device, a crane spreader with a locking device, or other generally T-shape lifter device. The lifter devices engage through the elongated recesses or apertures 21 of the lift fittings 18, and after reception by the lift fittings, are then rotated through 90° to a position of captive engagement, whereby lifting of the container can then take place via the lifter devices and the lift fittings 18.

The lift fittings 18 are, as mentioned above, provided inboard from the ends of the container so that the receiving apertures 21 are located at spacings apart which meet international standards to enable the container to be lifted by cranes currently available for use with standard size containers.

Each pair of opposed lift fittings 18 are rigidly secured to the members 19 and 20 of each respective portal frame, to provide sufficient strength to withstand applied loads during handling of the container. Each lift fitting 18 is generally a hollow shaped cube, which allows the cargo lifter devices to engage therewith. A clearer illustration of each receiving aperture 21 can be seen in FIG. 2.

As described in the introduction, it is known to provide lift fittings inboard of the ends of cargo containers of non-standard length, but current designs of mounting for the lift fittings require essentially the provision of additional internal strengthening of the portal frames, and which takes the form of triangular support gusset plates welded to the members of the portal frames near the joints between adjacent members, and which gusset plates project internally of the cargo space to give the necessary additional support. The intrusion of the lift fittings and the gusset plates into the cargo space makes loading difficult, and reduces the useful volume of the cargo container which can be loaded.

The preferred embodiment of the invention provides an improved design of lift fitting per se and in addition an improved means of mounting each lift fitting into the structure of the container. This will now be described in detail with reference to FIGS. 2 to 4.

Thus, each lift fitting 18 comprises a cast metal body designated generally by reference 22 and which is hollow, having elongate entrance recess 21 in its upper surface to receive the container lifter device, and this enables the lifter device to enter the body 22, and then to be rotated through 90° to a captive position. The depth of the body 22 is substantially smaller than the depth of a conventional ISO lifting device, and in fact the lifting device is able to pass downwardly through the body 22 after being received by recess 21, and takes-up a captive position below the underside of body 22, after rotation through 90°, whereby it then permits upward movement of the container via the lifter device and the lift fitting 18.

To permit this downward movement of the lifter device, the lower wall of the body 22 includes an apertured flexible lower wall portion 23 in the form of an apertured diaphragm or membrane, and the diaphragm is shown in one position in which it is accommodated within the interior of the body 22, and is shown by reference 23' which comprises the deformed position it can take-up after the lifter device has been pushed downwardly through the body 22.

In order to strengthen the mounting of each lift fitting 18 within the portal frame, a slot-like recess 24 extends vertically throughout the height of the body 22, and receives an inner post stiffener 25 which is rigidly secured thereto by welds 26, and the stiffener 25 is secured to and projects upwardly from an outer post 27 forming one of the upright members 19 of the portal frame, or is secured rigidly thereto. As can be seen in FIG. 4, inner post stiffener 25 is housed within a channel (or sleeve) 28 which forms part of the outer post 27, and which is welded at its upper end to the underside of body 22 via weld joints 29. The inner stiffener 10 projects upwardly of channel 28, to be received within, and to extend throughout the height of body 22. The mounting structure shown in FIG. 4 provides rigidity to the portal frame, and also provides a rigid assembly of the lift fitting 18 as a component part of the support structure.

In addition, the inwardly facing end 30 of body 22 is rigidly secured by welds 32 to a horizontal roof member 31 which is rigidly secured to top portal member 20, or actually constitutes top portal member 20 which is shown schematically in FIG. 1. A roof sheet 33 overlies the structure. In the assembly of each upright member of the portal frame to the respective lift fitting, usually the first operation will comprise welding of the inner post stiffener 25 to the body of the fitting, followed by welding of the channel 28 to the stiffener 25, and completed by welding of the assembled channel 28 and stiffener to the body 22. This further strengthens the portal frame, and gives rigidity to the structure, whereby the non-standard length container 10 can be readily lifted via lifter devices engaging with each lift fitting 18, without any unacceptable deformation of the structure of the container when loaded.

Figure 2:
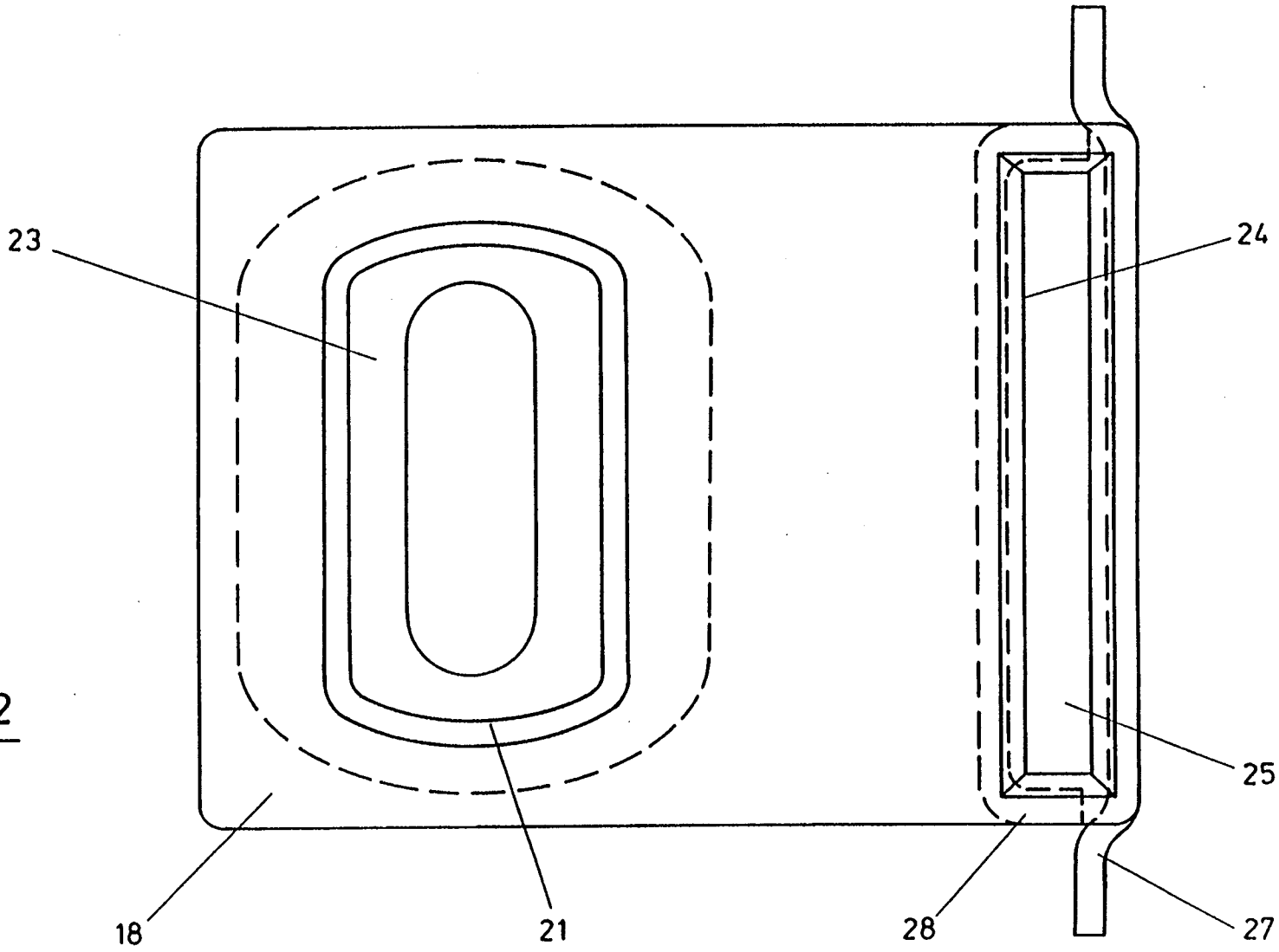
FIG. 2 is a detailed plan view of one of the lift fittings.
Figure 3:
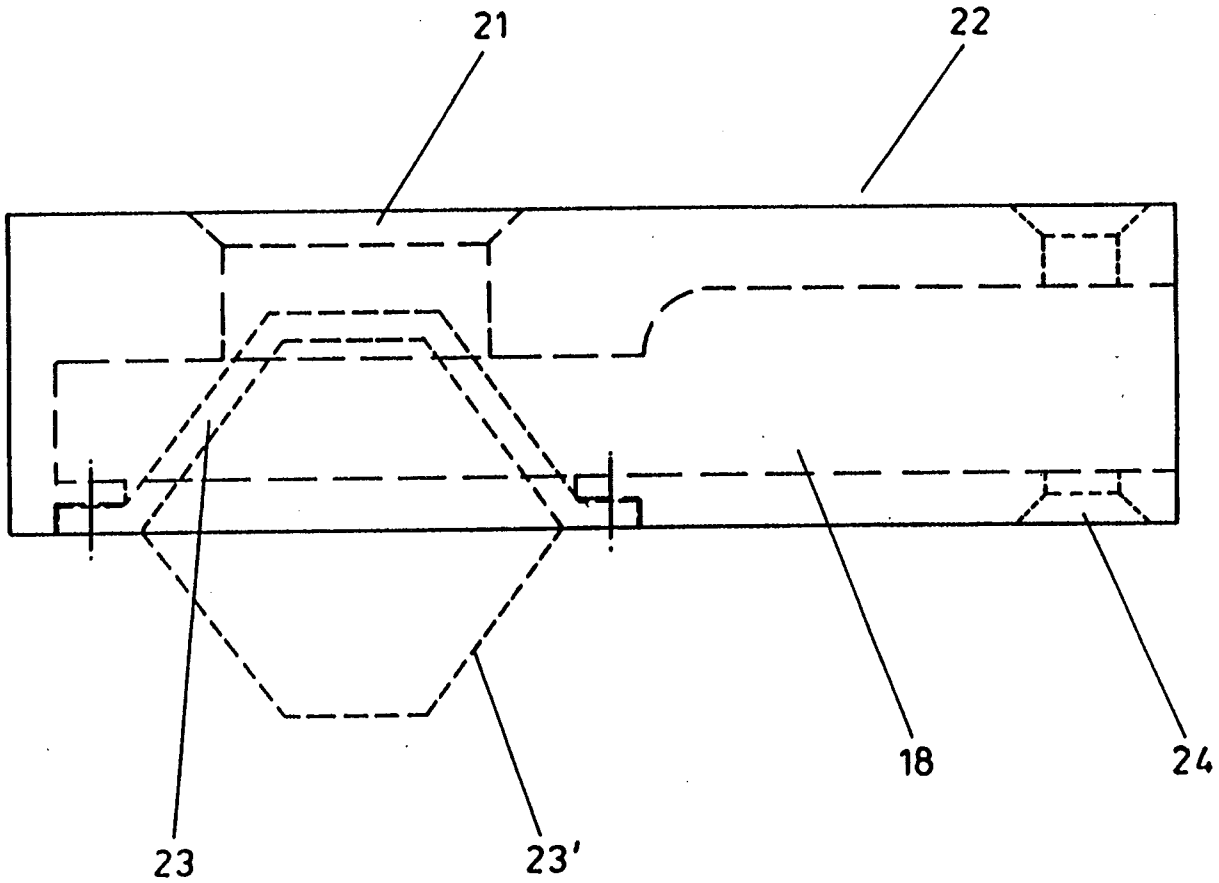
FIG. 3 is a side view of the lift fitting, and illustrating a twistlok type cargo lifter device in both engaged and disengaged positions; and, FIG. 4 is a vertical sectional view of the lift fitting and illustrating its securement to an internal strengthening portal frame of the container.
Figure 4:
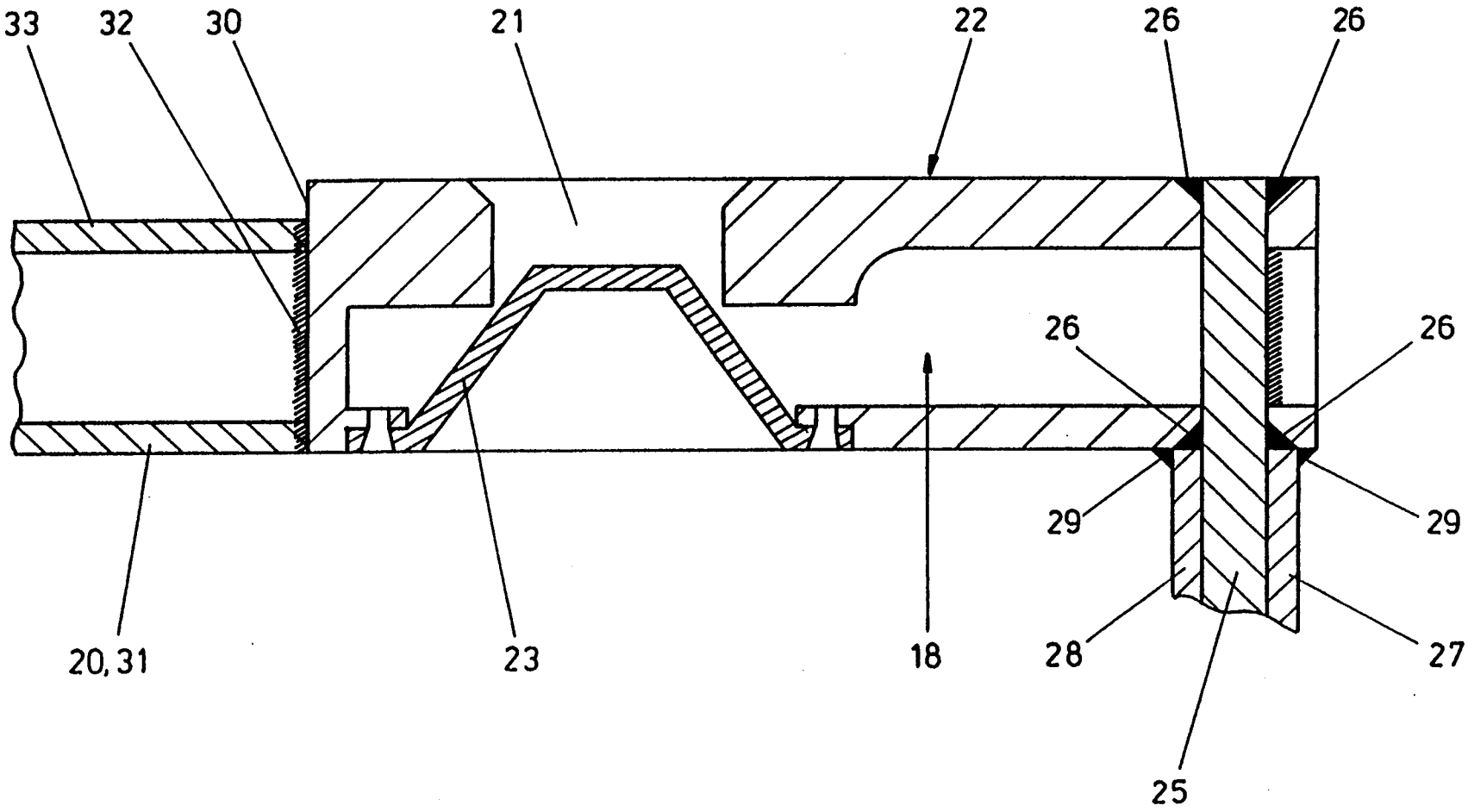

The preferred embodiment illustrated in FIGS. 2 to 4 therefore enables the previous use of triangular gussets to be unnecessary, thereby making available all of the internal cargo space, while providing a sufficiently rigid overall structure in a cargo container of non-standard length.

I claim:

1. a cargo container comprising:

(a) a base;

(b) a roof;

(c) an opposed pair of side walls extending between said roof and said base, said side walls having upper and lower edges by which said side walls are joined to said roof and said base, respectively;

(d) an opposed pair of end walls adjoining said side walls along four corner edges of the container;

(e) a portal frame configured to strengthen said roof and said side walls at opposed pairs of lifting positions located along said upper edges of each of said side walls inwardly of said corner edges of said end walls, said lifting positions in each pair thereof being spaced apart from each other by a predetermined distance along said upper edges of each of said side walls corresponding to the requirements of a container lifting device, said portal frame comprising:

i) two pairs of opposed upright posts, each pair of said upright posts being disposed against a respective one of said side walls with the upper end of each of said upright posts proximate to a respective one of said lifting positions;

ii) a pair of top members disposed against said roof, each of said top members interconnecting said upper end of one of said upright posts in one of said pairs thereof with said upper end of an individual one of said upright posts in the other of said pairs thereof; and iii) a post stiffener secured to and projecting upwardly of said upper end of each of said upright posts; and (f) two pairs of opposed lift fittings, each of said pairs of said lift fittings being mounted along a respective one of said upper edges of said side walls at said lifting positions thereon, at least one of said lift fittings comprising:

i) a hollow body configured to receive a container lifter device;

ii) an upper recess formed in said hollow body and configured to enable the container lifter device to enter said hollow body; and iii) a lower recess formed in said hollow body configured to receive a respective one of said post stiffeners, thereby to secure said lift fitting to said portal frame.

2. A cargo container as recited in claim 1, wherein said hollow body further comprises an apertured flexible lower wall so positioned and configured as to allow downward movement of the container lifter device into a captive position below the top of said lift fitting after entry of the container lifter device into said hollow body, thereby to permit upward movement of the container by the container lifter device and the lift fitting.

3. A cargo container as recited in claim 1, wherein said lower recess in said hollow body comprises a slot extending throughout the major part of the height of said lift fitting.

4. A cargo container as recited in claim 1, wherein each of said upright posts is hollow, and each of said respective stiffeners comprises an inner stiffener housed within said hollow upright post projecting upwardly therefrom and receivable in said lower recess in said respective lift fitting.

5. A cargo container as recited in claim 4, wherein said hollow upright outer post is welded on said upper end thereof to the underside of said hollow body of said respective lift fitting.

6. A cargo container as recited in claim 5, wherein said inner stiffener extends through said height of said hollow body and is welded thereto.

7. A cargo container as recited in claim 1, wherein a lower side of said hollow body includes an apertured flexible diaphragm deformable to allow downward movement of the container lifter device within said hollow body into captive engagement with said respective lift fitting.

8. A cargo container as recited in claim 1, wherein the depth of said lift fitting is less than the depth of a standard lift fitting.

9. A cargo container comprising:

(a) a base;

(b) a roof;

(c) an opposed pair of side walls extending between said roof and said base, said side walls having upper and lower edges by which said side walls are joined to said roof and said base, respectively;

(d) an opposed pair of end walls adjoining said side walls along four corner edges of the container.

(e) a portal frame configured to strengthen said roof and said side walls at opposed pairs of lifting positions located along said upper edges of each of said side walls inwardly of said corner edges of said end walls, said lifting positions in each pair thereof being spaced apart from each other by a predetermined distance along said upper edges of each of said side walls corresponding to the requirements of a container lifting device, said portal frame comprising:

i) two pairs of opposed upright posts, each pair of said upright posts being disposed against a respective one of said side walls with the upper end of each of said upright posts proximate to a respective one of said lifting positions;

ii) a pair of top members disposed against said roof, each of said top members interconnecting said upper end of one of said upright posts in one of said pairs thereof with said upper end of an individual one of said posts in the other of said pairs thereof; and iii) a post stiffener secured to and projecting upwardly of said upper end of each of said upright posts; and (f) two pairs of opposed lift fittings, each of said pairs of lift fittings being mounted along a respective one of said upper edges of said side walls at said lifting positions thereon, one of said lift fittings interconnecting said upper end of each of said upright posts with a respective one of said top members, at least one of said lift fittings comprising:

i) a hollow body configured to receive a container lifter device;

ii) an upper recess formed in said hollow body and configured to enable the container lifter device to enter said hollow body; and iii) an apertured flexible lower wall so positioned and configured as to allow downward movement of the container lifter device into a captive position below said lift fitting after entry of the container lifter device into said hollow body, thereby to permit upward movement of the cargo container by the container lifter device and the lift fitting.

10. A cargo container as recited in claim 9, wherein said lift fitting further comprises a lower recess formed in said hollow body, said lower recess being so positioned and configured as to receive a respective one of said post stiffeners, thereby to secure said lift fitting to said portal frame.

11. A cargo container as recited in claim 9, wherein said lower recess in said hollow body comprises a slot extending throughout the major part of the height of said lift fitting.

12. A cargo container as recited in claim 9, wherein a lower side of said hollow body includes an apertured flexible diaphragm deformable to allow downward movement of the container lifter device within said hollow body into captive engagement with said respective lift fitting.

13. A cargo container as recited in claim 9, wherein the depth of said lift fitting is less than the depth of a standard lift fitting.

14. A system for enabling lifting of a cargo container using a container lifting device having lifting points conforming to international standards, the lifting container being of the type having a base, a roof, and an opposed pair of side walls with upper edges by which the side walls are joined to the roof, and said system comprising:

(a) two pairs of opposed upright portal frame posts, each pair of said upright portal frame posts being disposed against a respective one of the walls of the cargo container, the upper end of each of said upright portal frame posts being disposed proximate to an individual one of opposed pairs of lifting positions located along the upper edges of each of the side walls and spaced apart from each other by a predetermined distance corresponding to the distance between the lifting points of the container lifting device;

(b) a lift fitting securable to the upper end of each of said upright portal frame posts, each of said lift fittings comprising:

i) a hollow body configured to receive the container lifter device; and ii) an upper recess in said hollow body configured to enable the container lifter device to enter said hollow body; and (c) a pair of top portal frame members disposed against the roof of the cargo container between the side walls thereof, each of said top portal frame members being interconnected by a corresponding one of said lift fittings to said upper end of one of said upright portal frame posts in each of said pairs thereof.

15. A system as recited in claim 14, further comprising a post stiffener secured to and projecting upwardly of said upper end of each of said upright portal posts, and wherein each of said lift fittings is secured to said upper end of said corresponding one of said upright portal frame posts by a lower recess formed in said hollow body of said lift fitting and configured to receive the upper end of a respective one of said post stiffeners.

16. A system as recited in claim 14, wherein said lift fitting further comprises an apertured flexible lower wall of said hollow housing so positioned and configured as to allow downward movement of the container lifter device into a captive position within said lift fitting after entry of the container lifter device into said hollow body thereof.

17. A system as recited in claim 14, wherein each of said upright portal frame posts comprises:

(a) a hollow outer post; and (b) an inner stiffener post housed within said hollow outer post and capable of being positioned therin to project upwardly from said upper end thereof.

18. A lift fitting of reduced depth for attachment to the edge of the roof of a cargo container to enable lifting of the cargo container by a lifting device having lifting points conforming to international standards, said lift fitting comprising:

(a) a hollow enclosure having generally parallel upper and lower walls, the distance between said upper and lower walls thereof defining the depth of said lift fitting;

(b) a generally elongate lifting device entry aperture formed in said upper wall of said enclosure, said entry aperture configured to enable the lifting device to be admitted into the interior of said enclosure and thereafter to be rotated into a captive position below said upper wall of said hollow enclosure;

(c) a lifting device clearance aperture formed in said lower wall of said enclosure opposite said lifting device entry aperture; and (d) a flexible diaphragm so mounted in said lifting device clearance aperture as to be capable of yielding into a deformed position in response to entry of the container lifting device into said hollow housing through said lifting device entry aperture, thereby to permit sufficient entry of the lifting device into said hollow housing to permit rotation of the lifting device into said captive position when said height of said lift fitting is less than the height of a standard lift fitting.

19. A lift fitting as recited in claim 18, wherein said flexible diaphragm in an undeformed position thereof is dome-shaped, and said flexible diaphragm is mounted in said lifting device clearance aperture with the concavity of said dome shape oriented downwardly and the upper surface of said diaphragm in close proximity to said lifting device entry aperture.

20. A lift fitting as recited in claim 19, wherein a vertically oriented slot is formed in an outer periphery of said hollow enclosure between said bottom and top walls thereof, said slot being so configured as to receive the end of a structural element of the cargo container, thereby to secure said lift fitting to the cargo container.

* * * * *